US012044485B2

(12) United States Patent
Wright, Jr. et al.

(10) Patent No.: US 12,044,485 B2
(45) Date of Patent: Jul. 23, 2024

(54) ADIABATIC PRE-COOLING REDISTRIBUTION SYSTEM

(71) Applicant: Evapco, Inc., Taneytown, MD (US)

(72) Inventors: Kenneth Calvin Wright, Jr., Hanover, PA (US); Patrick Stephen Johnson, Eldersburg, MD (US)

(73) Assignee: Evapco, Inc., Taneytown, MD (US)

( * ) Notice: Subject to any disclaimer, the term of this patent is extended or adjusted under 35 U.S.C. 154(b) by 167 days.

(21) Appl. No.: 17/711,504

(22) Filed: Apr. 1, 2022

(65) Prior Publication Data

US 2022/0316826 A1 Oct. 6, 2022

Related U.S. Application Data

(60) Provisional application No. 63/169,420, filed on Apr. 1, 2021.

(51) Int. Cl.

| | |
|---|---|
| ***F28F 25/08*** | (2006.01) |
| ***F24F 5/00*** | (2006.01) |
| ***F24F 13/22*** | (2006.01) |
| ***F28C 1/14*** | (2006.01) |
| ***F28C 3/06*** | (2006.01) |
| ***F28C 3/08*** | (2006.01) |
| ***F28F 25/02*** | (2006.01) |
| ***F28F 25/04*** | (2006.01) |

(52) U.S. Cl.

CPC ..... *F28F 25/04* (2013.01); *F24F 5/0035* (2013.01); *F28C 1/14* (2013.01); *F28F 25/087* (2013.01)

(58) Field of Classification Search

CPC ..... F25C 1/14; F25B 2339/041; F25B 9/04; F28B 9/06; F28B 9/08; F24F 5/0035; F24F 2013/225; F28C 3/06; F28C 3/08; F28F 25/02; F28F 25/04; F28F 25/08; F28F 25/087

See application file for complete search history.

(56) References Cited

U.S. PATENT DOCUMENTS

| | | | | |
|---|---|---|---|---|
| 4,031,180 | A | 6/1977 | Bohanon | |
| 4,312,819 | A * | 1/1982 | Leyland | F28D 5/00 261/36.1 |
| 9,310,134 | B2 | 4/2016 | Gilbert | |

(Continued)

FOREIGN PATENT DOCUMENTS

| | | | |
|---|---|---|---|
| CN | 111964245 | 11/2020 | |
| EP | 0643278 | 7/1997 | |
| WO | WO-2020074587 A1 * | 4/2020 | F24F 5/0035 |

OTHER PUBLICATIONS

International Search Report issued in corresponding International Patent Application No. PCT/US22/23069 on Jul. 14, 2022.

*Primary Examiner* — Frantz F Jules
*Assistant Examiner* — Jason N Thompson
(74) *Attorney, Agent, or Firm* — Whiteford, Taylor & Preston, LLP; Peter J. Davis

(57) ABSTRACT

A water redistribution system for adiabatically pre-cooled dry coolers having stacked adiabatic panels, the water redistribution system located between upper and lower adiabatic panels and having a plurality of alternating baffles arranged to reduce water free-fall height and resultant splashing. Upwardly turned flanges at the top of each baffle inhibit the travel of water out of the interior water channel.

17 Claims, 5 Drawing Sheets

(56) References Cited

U.S. PATENT DOCUMENTS

| | | | | |
|---|---|---|---|---|
| 2010/0162737 | A1* | 7/2010 | Hall | F24F 6/043 62/310 |
| 2011/0100593 | A1* | 5/2011 | Benz | F28D 1/0477 165/59 |
| 2012/0211198 | A1* | 8/2012 | Kinkel | F24F 1/0358 165/104.14 |
| 2013/0276476 | A1* | 10/2013 | Wong | F28F 25/04 165/104.13 |
| 2014/0144171 | A1* | 5/2014 | Smith | F28F 25/04 62/304 |
| 2016/0054039 | A1* | 2/2016 | Wong | F25B 39/04 62/506 |
| 2018/0094884 | A1* | 4/2018 | Rousselet | F28C 1/00 |
| 2019/0137183 | A1 | 5/2019 | Byrne | |

* cited by examiner

ADIABATIC PRE-COOLING REDISTRIBUTION SYSTEM

BACKGROUND OF THE INVENTION

Field of the Invention

The present invention relates to adiabatically pre-cooled dry heat exchange systems.

Description of the Background

Adiabatic pre-cooling systems require fully saturated adiabatic media to lower the entering air dry-bulb temperature by increasing the moisture content of the air. Large adiabatic systems have wet media stacked on top of one-another to cover the face of large air-cooled heat exchangers; see, for example the prior art modular adiabatic air cooled heat exchanger shown in FIG. 1. As shown in FIG. 1, a water distribution tube is located above the top adiabatic pre-cooling pads and drips or sprays water onto the top adiabatic pads. Water that passes through the top adiabatic pads drains into the bottom adiabatic pads.

SUMMARY OF THE INVENTION

The inventors have discovered that the stacked wet media requires an intermediate section that either redistributes or removes the drain water from the top adiabatic section and supplies water to the lower adiabatic section. However, potential problems of an adiabatic redistribution system might include water migration, maldistribution, and/or require the use of sealants. Water migration could be caused from splashing of the drain water or poor design of the redistribution system. Water migration could cause the adiabatic performance to suffer if leaking water prevents the wetted media from being fully saturated. Wet media that is not fully saturated will cause the overall heat rejection equipment to not perform as intended leading to higher energy consumption and higher leaving fluid temperatures. Water mitigation could also lead to unwanted corrosion of the adiabatic system or heat rejection equipment and structure. Corrosion of the heat transfer surface will lead to higher energy consumption and higher leaving fluid temperatures. Lastly, leaking water can puddle or pool up inside the heat rejection equipment, where the fan or air moving device can aerosolize the water and cause the spread of *Legionella*.

Adiabatic redistribution systems that do not evenly distribute the drain water to the distribution trough in the lower section could cause non fully saturated wet media. Again, wet media that is not fully saturated will cause the overall heat rejection equipment to not perform as intended leading to higher energy consumption and higher leaving fluid temperatures.

Typically, sealants are used on rigging seams and joins to prevent water migration. However, the use of sealants could lead to potential problems in adiabatic redistribution systems as over time they could degrade leaving the adiabatic system vulnerable to water migration. An adiabatic redistribution system design that incorporates a field rigging seam could result in riggers forgetting to apply the appropriate sealants during installation.

The present invention seeks to provide a solution to these anticipated problems by providing an intermediate system with a waterfall/baffle design that redirects and reduces the splash height and containment of redistributed water without the use of sealants.

According to the invention, water entering the adiabatic redistribution system comes from the drain water coming off the top adiabatic section through a drain channel. From the drain channel the water falls onto one or more angled baffles which allow the water to runoff and minimize splashing. The angled baffles are laid out in a zig-zag pattern allowing the water to cascade downwards. After going through the baffles, the water will fill up a distribution trough for distribution to the lower adiabatic system. The baffle design allows the redistribution to be free of sealants and prevents water from escaping the internal canal of the entire adiabatic system.

The waterfall/baffle design of the invention redirects the water away from the exterior casing seams, keeping the water internal to the redistribution system and obviating the need for sealants on those seams. The exterior casing seams also have sheet metal breaks that are set at angles configured to force the water to go uphill in order to escape the internal canal of the distribution system. Along with moving the water away from the seams, the baffles reduce the vertical distance the water has to free-fall. Reducing this free-fall height reduces splashing inside the canal where extensive amounts or large splashes could push water into exterior seams. Reducing splashing and protecting the exterior seams will prevent water migration outside of the redistribution system and eliminate the need for sealants.

The waterfall/baffle design of the invention supports the even distribution of water across the length of the redistribution system. The lower adiabatic section distribution trough requires a certain amount of head and water level to ensure the wet media is fully saturated. The reduction of splashing will reduce the turbulence of the water. Less turbulence will promote an even distribution of the water and an even water level throughout the trough.

BRIEF DESCRIPTION OF THE DRAWINGS

The subsequent description of the preferred embodiments of the present invention refers to the attached drawings, wherein:

FIG. 2 is a side view of an adiabatic air-cooled heat rejection system with stacked panels and.

Figure 1:
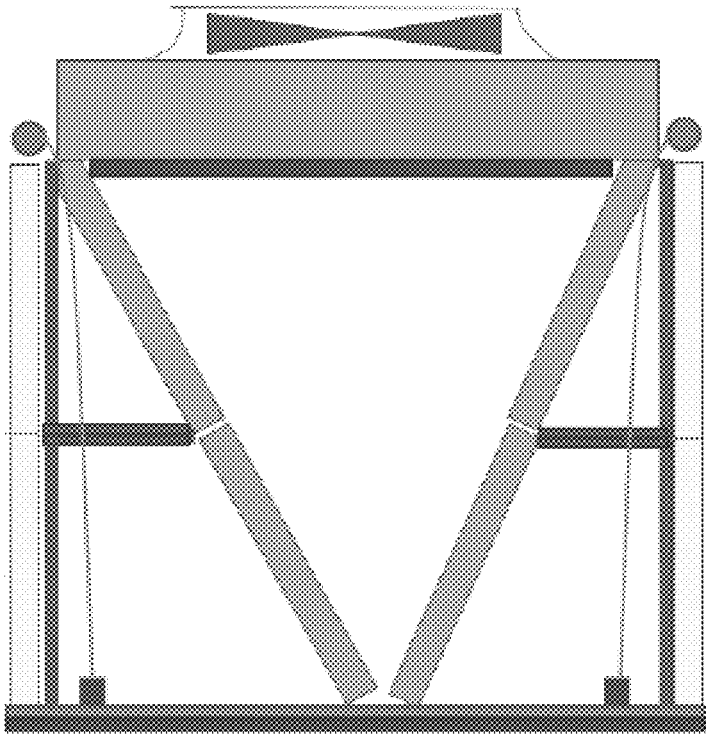
Figure 1 (Prior Art)
FIG. 1 is a representation of a prior art modular adiabatic air-cooled heat rejection system with stacked adiabatic panels.

Features in the attached drawings are numbered with the following reference numerals:

1 Adiabatic System
2 Dry Cooler
3 Adiabatic Water Distribution System
4 Adiabatic Media

5 Adiabatic Redistribution System
6 Adiabatic Media
7 Drain Channel
8 Upper Adiabatic Section Drain Pan
9 Large Winged Angled Baffle
10 Small Winged Angled Baffle
11 Removable Angled Baffle
12 Lower Adiabatic Section Distribution Trough
13 Supporting Exterior Structure
14 Handles
15 Distribution Pad Media
16 Water Flow path
18 Fan
20 Upwardly Turned Flange
22 Downwardly Turned Flange
24 Side Barriers

DETAILED DESCRIPTION

Figure 2:
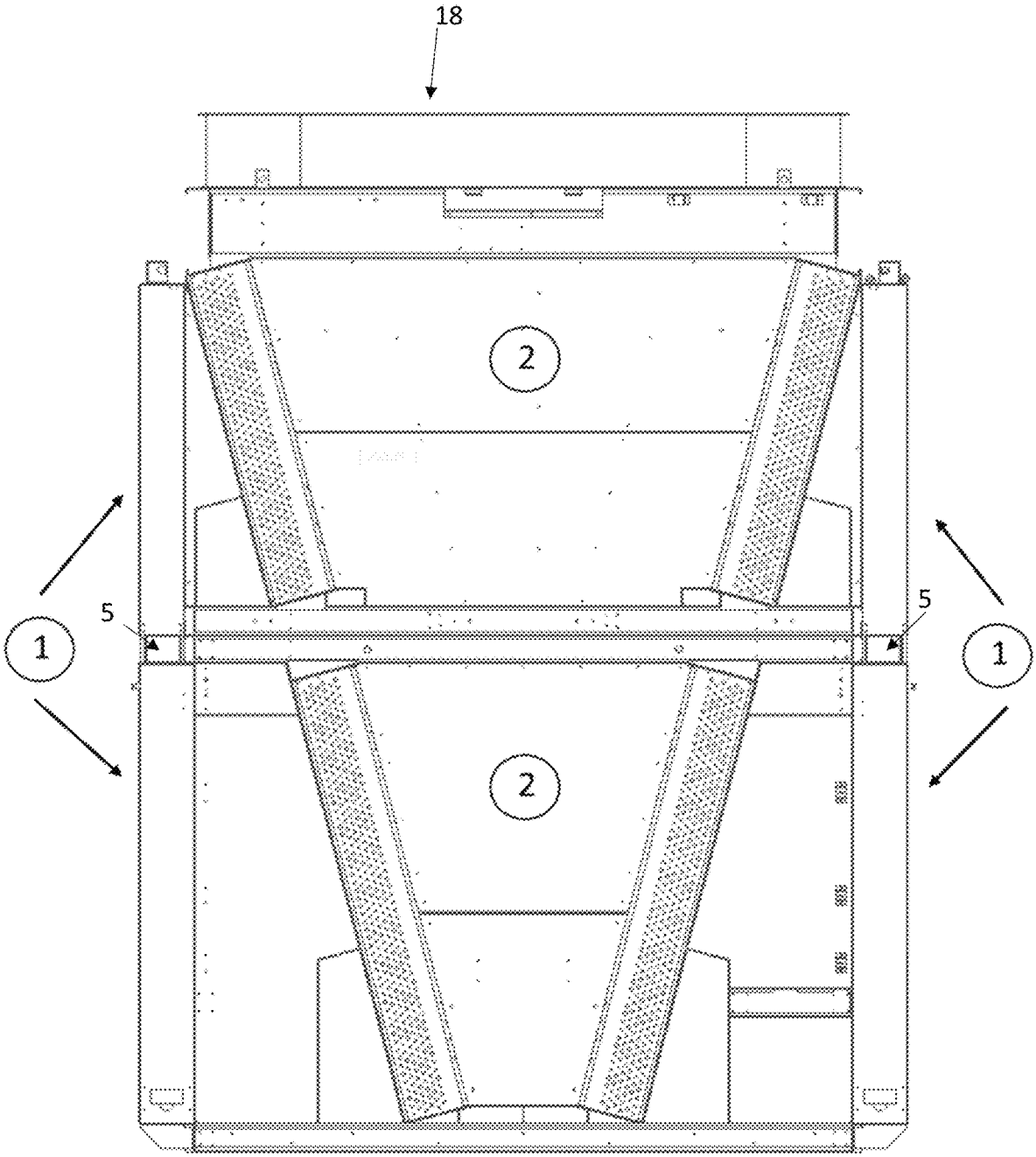
Figure 3:
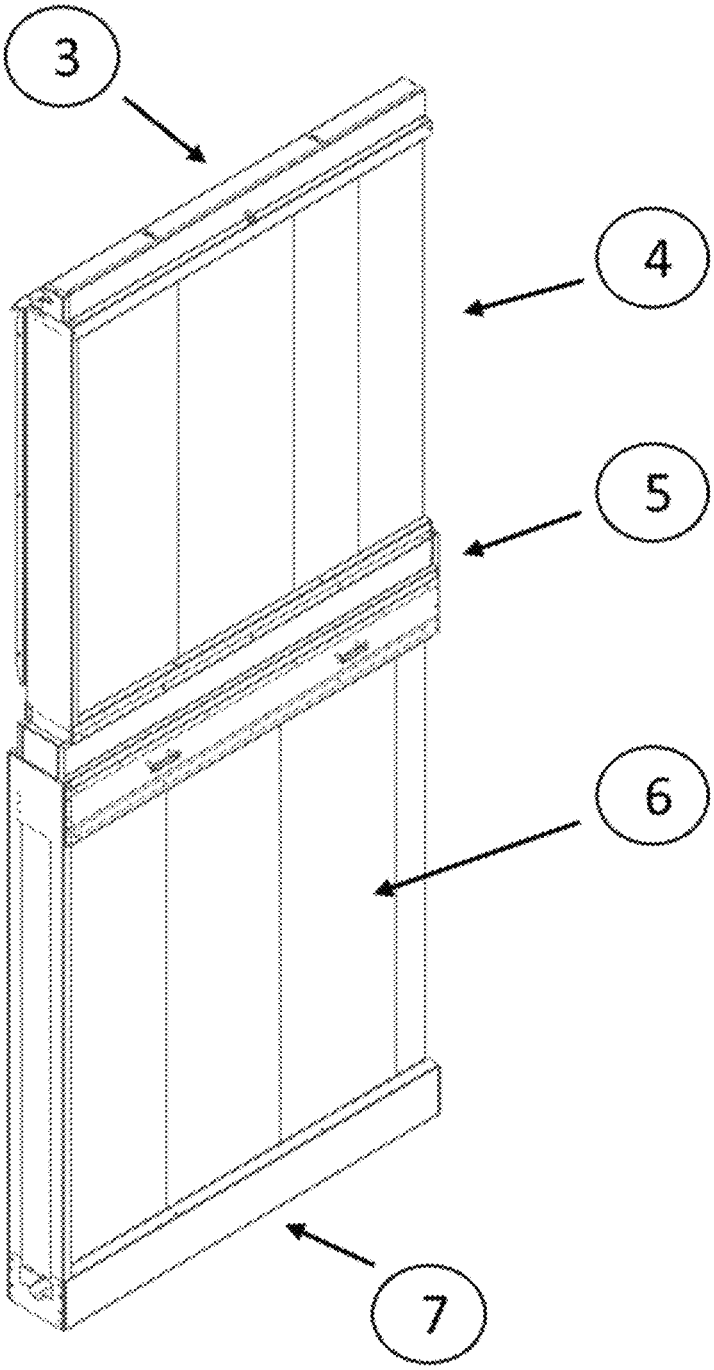
FIG. 3 is a perspective view of a pre-cooling adiabatic system according to the invention, having upper and lower adiabatic sections and an adiabatic water re-distribution system according to an embodiment of the invention arranged between the upper and lower adiabatic sections.

Referring to FIGS. 2 and 3, adiabatic pre-cooled dry air cooler heat rejection system 1 includes adiabatic pre-cooling system 2. Adiabatic pre-cooling system 2 includes water distribution system 3 arranged to distribute adiabatic pre-cooling water over section(s) of adiabatic media 4, 6. Air is drawn through adiabatic media 4, 6 and through dry cooler 2 via fan 18, pre-conditioning the air to improve performance of the dry cooler 2. The water is distributed via the adiabatic water distribution system 3 onto the upper section of adiabatic media 4. Water then enters the adiabatic redistribution system 5 to be redistributed onto the lower section of adiabatic media 6. Water is ultimately collected in the drain channel 7. Water collected in drain channel 7 may optionally be sent via pump and return pipes to water distribution system 3. Water distribution system 3 may be any kind of water distribution system, including a water tube arranged across the top of adiabatic media 4 with holes in the bottom of the water tube. The holes may be bare, or may be fitted with nozzles.

Figure 4:
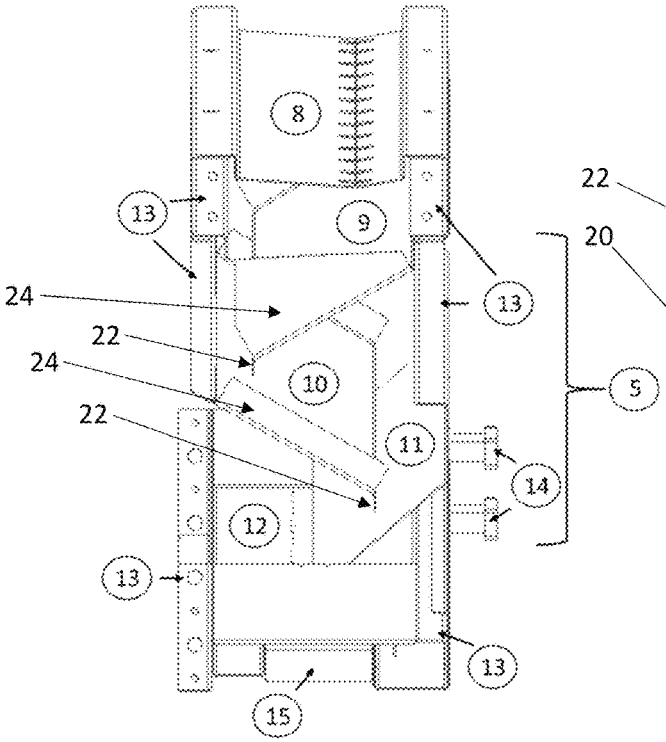
FIG. 4 is an overhead perspective view of an adiabatic redistribution system according to an embodiment of the invention.
Figure 5:
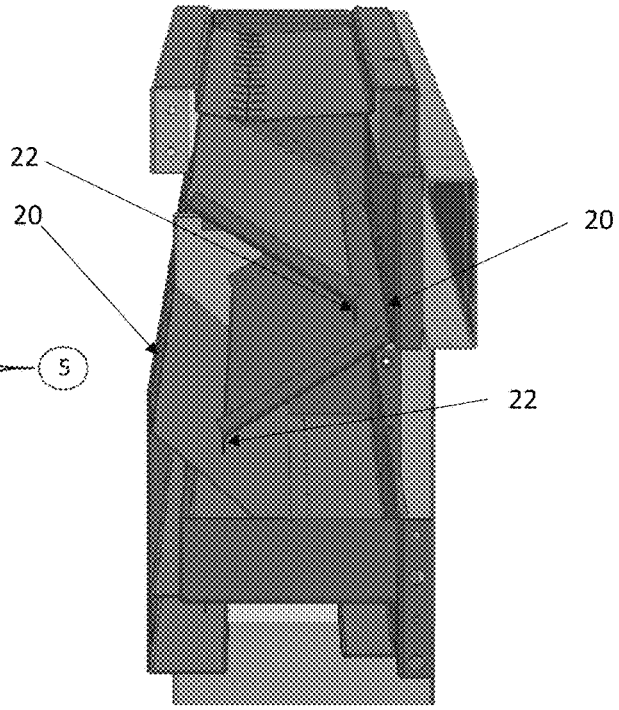
FIG. 5 is a side perspective view of an adiabatic redistribution system according to another embodiment of the invention.
Figure 6:
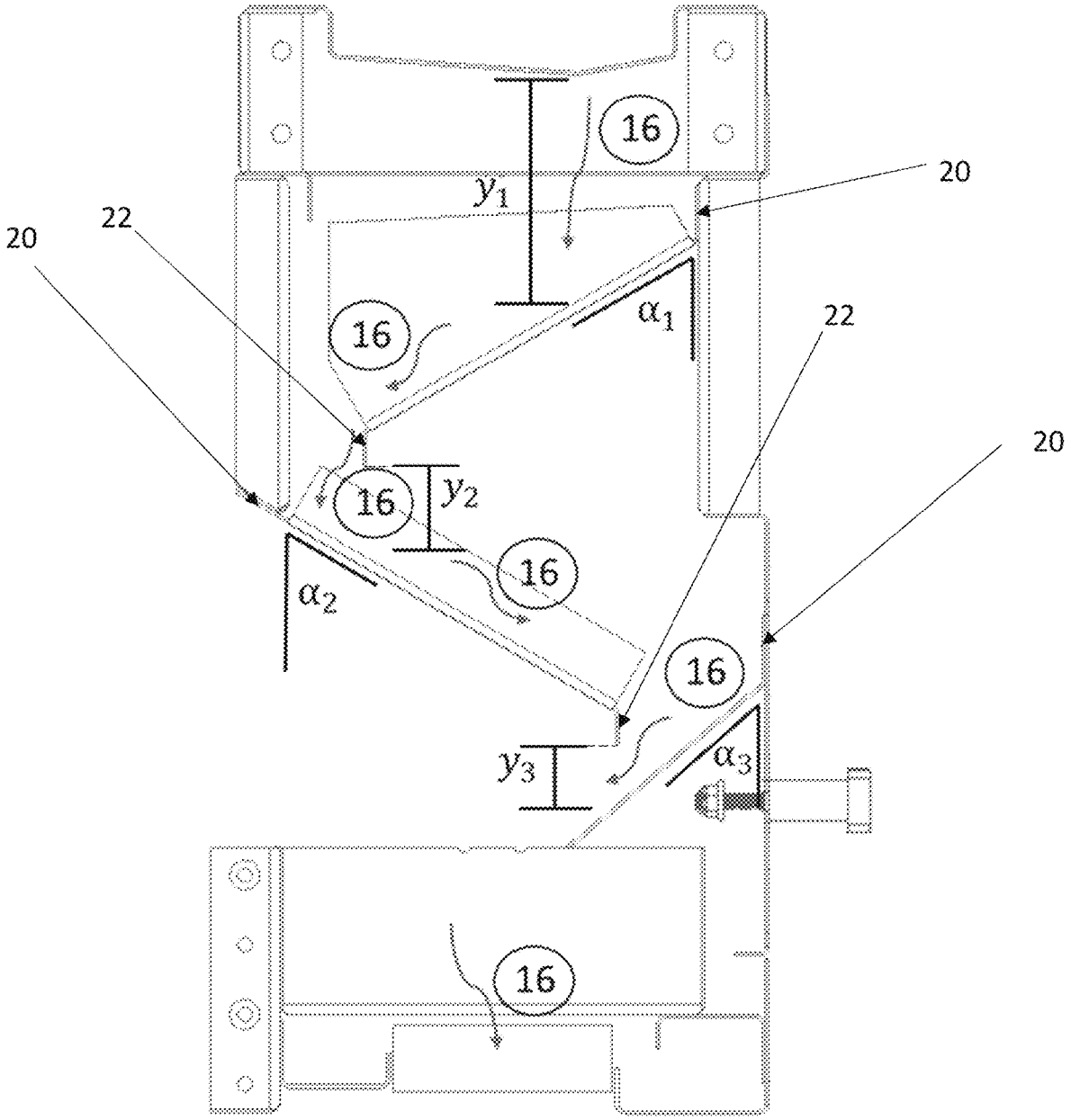
FIG. 6 is a side view of an adiabatic water redistribution according to the embodiment of FIG. 4.

Referring now to FIGS. 4-6, the redistribution system 5 includes upper drain pan 8 which is located to receive water draining from the bottom of adiabatic pads in upper adiabatic media section 4. Upper drain pan 8 may be formed in the shape of a bevel or a V to create a longitudinal channel. Beneath upper drain pan 8, a plurality of angled baffles 9, 10, 11 are arranged connected to exterior casing structure 13. The baffles 9, 10, 11 are preferably arranged in an alternating or zig-zag pattern that allows the water to cascade down the interior of the casing structure 13. Holes formed in the bottom of upper drain pan 8 permit water collected in upper drain pan 8 to flow sequentially onto the plurality of angled baffles 9, 10 and 11 which allows the water to runoff and minimizes splashing, as shown by the arrows indicating the cascade flow path 16 in FIG. 6. At the end of the cascade flow path 16, the water reaches the lower adiabatic section distribution trough 12. The trough 12 is provided with a series of drain holes to permit distribution of the water over distribution pad media 15, which in turn distributes water over the adiabatic pads of lower adiabatic section 6. The plurality of baffles 9, 10, 11 allows the adiabatic redistribution system 5 to be free of sealants and prevents water from escaping the internal canal of the entire adiabatic system 1. The top side of each of the plurality of baffles preferably features an upwardly turned flange 20, which flange is the attachment point between the baffles and the frame 13, the upward direction of the flange configured to inhibit the escape/loss of water from the system. Additionally, the bottom side of each baffle may be provided with a downwardly turned flange 22 which may inhibit the splashing of water onto a lower baffle through water surface tension and adhesion. The sides of each baffle may optionally be provided with side barriers 24 to inhibit water escape/loss from the sides of the baffles.

While the embodiment described herein includes three baffles, the water distribution system of the invention may include fewer or more baffles.

The baffles are preferably arranged at angles $\alpha_1$, $\alpha_2$, $\alpha_3$ from the vertical components of the frame 13 to control the flowrate of the water through the redistribution system 5. Angles $\alpha_1$, $\alpha_2$, $\alpha_3$ may all be the same, or they may be different from one-another. Angles $\alpha_1$, and $\alpha_2$ may be set anywhere between 30° and 75°, preferably between 45° and 75° and most preferably at about 60°. Angle $\alpha_3$ may be set anywhere between 30° and 75°, preferably between 35° and 65° and most preferably at about 50°.

If more baffles are used, angles $\alpha_1$, $\alpha_2$, $\alpha_3$ may typically be at the higher end of the range (shallower slope). Where fewer baffles are used, angles $\alpha_1$, $\alpha_2$, $\alpha_3$ may typically be at the lower end of the range all be the same (steeper slope).

The alternating baffle pattern/arrangement disclosed herein breaks a water drop height into component free fall heights y1, y2, y3, effectively reducing its splash height. By reducing splash height, water is directed away from structural seams in a controlled manner. This reduces or eliminates the need for structural sealants. Baffles may be arranged so that free fall heights y1, y2, y3 are all the same, or are different. Free fall height y1 may preferably be set anywhere between 3.5 inches and 5 inches, and more preferably at about 4.17 inches. Free fall height y2 may preferably be set anywhere between 1.0 inches and 2.0 inches, and more preferably at about 1.4 inches. Free fall height y3 may preferably be set anywhere between 0.5 inches and 1.5 inches, and more preferably at about 1.05 inches.

In a preferred embodiment, one or more of the angled baffles is integrated with a removable panel 11 that can be temporarily removed via handles 14 for maintenance and cleaning purposes.

It will be appreciated by those skilled in the art that changes could be made to the preferred embodiments described above without departing from the inventive concept thereof. It is understood, therefore, that this invention is not limited to the particular embodiments disclosed, but it is intended to cover modifications within the spirit and scope of the present invention as outlined in the present disclosure and defined according to the broadest reasonable reading of the claims that follow, read in light of the present specification. In particular, any adiabatic water re-distribution system that includes alternating baffles in any number is considered to fall within the scope of the invention. In addition, the use of upper water collection trays, lower water collection trays and water re-distribution pads may be optional. Furthermore, the adiabatic water re-distribution system described herein may be used between any two adiabatic pads or other adiabatic media where one adiabatic pad/media is located above another, including where two, three or more rows of adiabatic media are stacked above one-another.

The invention claimed is:

1. A water re-distribution system configured for mounting between upper and lower adiabatic pads of an adiabatic air pre-cooling system for a dry cooler, said water redistribution system comprising a plurality of downwardly slanted water deflection baffles alternatively arranged across from one-another and vertically relative to one-another in a water re-distribution frame, said plurality of water deflection baffles configured to deflect falling water in alternating directions as said water alternately traverses subsequent ones of said plurality of water deflection baffles.

2. A water re-distribution system according to claim 1, further comprising an upper water collection tray located above said plurality of water deflection baffles, said upper water collection tray configured to drop water onto a first of said plurality of water deflection baffles.

3. A water re-distribution system according to claim 1, further comprising a bottom water collection tray located below a lowest water deflection baffle.

4. A water re-distribution system according to claim 1, further comprising a water re-distribution pad located at a bottom of said water re-distribution system, said water re-distribution pad configured to re-distribute water to said lower adiabatic pads.

5. A water re-distribution system according to claim 1, wherein each one of said plurality of water deflection baffles comprises an upwardly turned flange, wherein each said upwardly turned flange constitutes an attachment point between a respective one of said plurality of water deflection baffles and an interior surface of said frame.

6. A water re-distribution system according to claim 1, wherein said water re-distribution system comprises no sealants.

7. A water re-distribution system according to claim 1, wherein said water deflection baffles are arranged at an angle from 35° to 75° from a vertical surface of said frame.

8. A water re-distribution system according to claim 1, wherein no water free-fall height in said water re-distribution system exceeds 5 inches.

9. A heat exchanger, comprising:

a frame;

two tube bundles arranged in said frame;

each of said tube bundles having an inlet header and an outlet header, said inlet header configured and located to receive hot process fluid and to distribute it to a corresponding tube bundle and said outlet header configured and located to receive cooled process fluid from said tube bundle;

said two tube bundles each comprising a plurality of horizontally arranged finned tubes connected to adjacent tubes with tube bends;

a plurality of fans supported by said frame above said tube bundles configured to draw air through said tube bundles and out through a top of said fan;

a plurality of upper and lower adiabatic pads mounted in said frame adjacent to an air intake side of said tube bundles;

a water distribution system comprising one or more water distribution tubes configured and located above said adiabatic pads and configured to deliver water to said adiabatic pads;

a water re-distribution system mounted in said frame and located between said upper adiabatic pads and said lower adiabatic pads, said water re-distribution system comprising a plurality of downwardly slanted water deflection baffles alternatively arranged across from one-another and vertically relative to one-another in said frame below said upper adiabatic pads, said plurality of water deflection baffles configured to deflect water falling from said upper adiabatic pads in alternating directions as said water alternately traverses subsequent ones of said plurality of water deflection baffles;

said dry adiabatic cooler further comprising a water collection tray located below said lower adiabatic pads.

10. A heat exchanger according to claim 9, said water re-distribution system further comprising a upper water collection tray located between said upper adiabatic pads and a topmost of said plurality of water deflection baffles.

11. A heat exchanger according to claim 9, said water re-distribution system further comprising a bottom water collection tray located below a lowest water deflection baffle.

12. A heat exchanger according to claim 9, said water re-distribution system further comprising a water re-distribution pad located below said bottom water collection tray, said water re-distribution pad configured to re-distribute water to said lower adiabatic pads.

13. A heat exchanger according to claim 9, wherein each said water deflection baffles comprises an upwardly turned flange, wherein each said upwardly turned flange constitutes an attachment point between a respective one of said plurality of water deflection baffles and an interior surface of said frame.

14. A heat exchanger according to claim 9, wherein said water re-distribution system comprises no sealants.

15. A heat exchanger according to claim 9, wherein said water deflection baffles are arranged at an angle from 35° to 75° from a vertical surface of said frame.

16. A heat exchanger according to claim 9, wherein no water free-fall height in said water re-distribution system exceeds 5 inches.

17. A heat exchanger according to claim 9, wherein said heat exchanger is an adiabatically pre-cooled dry cooler.

* * * * *